US007267420B2

(12) United States Patent
Yagi

(10) Patent No.: US 7,267,420 B2
(45) Date of Patent: Sep. 11, 2007

(54) LIQUID EJECTION HEAD INSPECTION METHOD AND PRINTER DEVICE

(75) Inventor: Takashi Yagi, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 372 days.

(21) Appl. No.: 11/067,880

(22) Filed: Feb. 28, 2005

(65) Prior Publication Data

US 2006/0061615 A1 Mar. 23, 2006

(30) Foreign Application Priority Data

Sep. 22, 2004 (JP) ..... 2004-275346

(51) Int. Cl.
*B41J 29/393* (2006.01)
*B41J 29/38* (2006.01)

(52) U.S. Cl. ..... 347/19; 347/12; 347/14

(58) Field of Classification Search ..... 347/19
See application file for complete search history.

(56) References Cited

FOREIGN PATENT DOCUMENTS

JP 11-064175 3/1999
JP 2002-127405 5/2002
JP 2004-009501 1/2004

*Primary Examiner*—Julian D. Huffman
(74) *Attorney, Agent, or Firm*—Fildes & Outland, P.C.

(57) ABSTRACT

The present invention provides inspection of a liquid ejection head which is equipped with plural nozzles at which piezoelectric elements are provided and which ejects recording liquid droplets from the individual nozzles in accordance with application of a driving signal voltage to the individual piezoelectric elements. A first voltage is applied to each individual piezoelectric element for measuring a resonance frequency of the individual piezoelectric element, a second voltage which is higher than the first voltage is applied to the individual piezoelectric element for measuring a resonance frequency of the individual piezoelectric element, and on the basis of the resonance frequencies at the times of application of the first voltage and the resonance frequencies at the times of application of the second voltage, piezoelectric elements that are likely to be susceptible to failure over time are detected.

20 Claims, 7 Drawing Sheets

FIG. 4A WAVEFORM OF SECOND VOLTAGE (A CASE OF UNSUITABLE SETTINGS OF AMPLITUDE AND BIAS VOLTAGE)
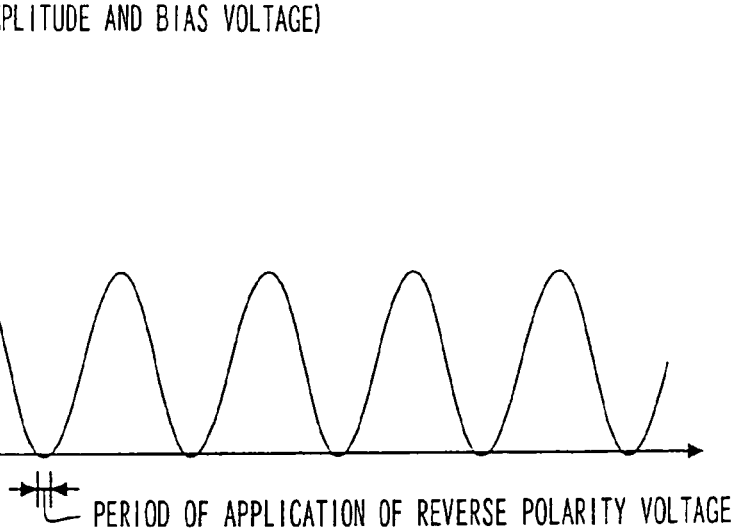
FIG. 4B WAVEFORM OF SECOND VOLTAGE (WITH BIAS VOLTAGE ADDED)
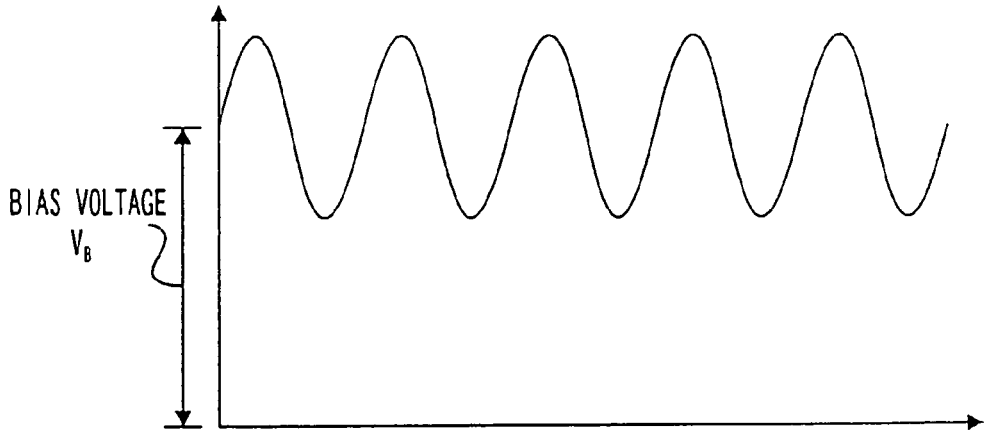
FIG. 4C ANOTHER EXAMPLE OF WAVEFORM OF SECOND VOLTAGE (LARGE AMPLITUDE, SMALL BIAS VOLTAGE)
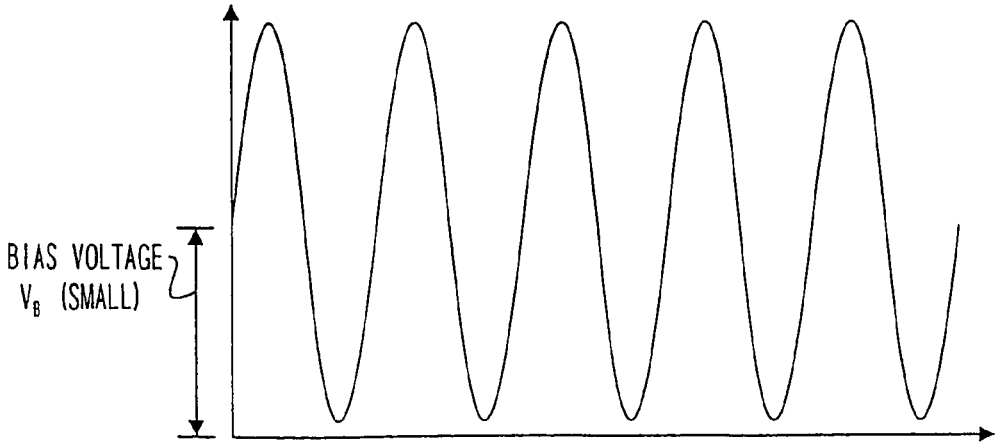

EXAMPLE OF FREQUENCY CHARACTERISTIC OF ADMITTANCE (IMPEDANCE) OF A PIEZOELECTRIC ELEMENT

LIQUID EJECTION HEAD INSPECTION METHOD AND PRINTER DEVICE

CROSS-REFERENCE TO RELATED APPLICATION

This application claims priority under 35 USC 119 from Japanese Patent Application No. 2004-275346, the disclosure of which is incorporated by reference herein.

BACKGROUND OF THE INVENTION

1. Field of the Invention

The present invention relates to a liquid ejection head inspection method and a printer device, and more particularly relates to a method for inspecting a liquid ejection head in which plural nozzles provided with plural piezoelectric elements are provided, the liquid ejection head being configured to eject droplets of recording liquid from the individual nozzles in accordance with the application of driving voltages to the individual piezoelectric elements, and to a printer device in which this liquid ejection head inspection method can be applied.

2. Description of the Related Art

Inkjet recording systems record images of text, photographs and the like on recording media (sheets, papers or the like) by adhering ink droplets ejected from nozzles of recording heads to the recording media. Heretofore, on-demand-type recording has been known as one kind of inkjet recording system. The on-demand type of system is a system in which ink droplets are ejected intermittently from nozzles in accordance with recording information. One well-known form of the on-demand type is the piezoelectric system, in which piezoelectric elements are displaced in accordance with the application of driving signal voltages to the piezoelectric elements, the displacements are transmitted through oscillating diaphragms to pressure chambers filled with ink, and ink droplets are ejected from nozzles by pressure fluctuations in the pressure chambers.

A piezoelectric system recording head is fabricated by respectively joining numerous piezoelectric elements to positions of a flow channel plate that correspond with individual nozzles, and then connecting electrical wiring to the individual piezoelectric elements and attaching an ink supply channel. The piezoelectric elements are formed by film-formation of an electrode material at piezoelectric bodies and are joined by adhesion or the like. Large numbers of oscillating diaphragms, ink flow channels, pressure chambers, the nozzles and the like are formed at the flow channel plate. However, among the numerous piezoelectric elements which are joined on, there may be piezoelectric elements with joining problems, piezoelectric elements which contain cracks, and the like. Hence, such piezoelectric elements may lead to problems in the ejection of ink. Therefore, during fabrication of a printer device or during distribution, it is necessary to inspect a recording head thereof for the inclusion or absence of piezoelectric elements which could lead to ink ejection problems in the recording head, and to remove recording heads that include the piezoelectric elements mentioned above from distribution.

It is common for an inspection of whether or not piezoelectric elements which will cause ink ejection problems are included in a recording head to be implemented by measuring respective frequency characteristics of impedance of the individual piezoelectric elements provided in the recording head and comparing resonance frequencies of the individual piezoelectric elements with respective threshold values. For example, Japanese Patent Application Laid-Open (JP-A) No. 11-64175 has disclosed a technology in which an impedance analyzer is connected to each nozzle, a characteristic frequency (resonance frequency) of the piezoelectric element that is provided in correspondence with the nozzle is measured, and any piezoelectric element that exhibits a characteristic frequency which is offset from a characteristic frequency of piezoelectric elements whose adhesion conditions are normal is judged to have an adhesion problem.

Further, JP-A No. 2002-127405 has disclosed a technology in which piezoelectric elements are driven, currents flowing in the piezoelectric elements are detected, and a piezoelectric element or piezoelectric element-driving circuit is judged to be faulty when a detected current is outside a prescribed range. Meanwhile, JP-A No. 2004-9501 has disclosed a technology in which a measuring section which measures resonance frequency during driving of piezoelectric elements is provided at an inkjet printer, and resonance frequency data is memorized in a storage section for reference. Changes in resonance frequency during piezoelectric element driving are measured, and thus non-ejection of ink due to the occurrence of a problem at a piezoelectric element or the formation of bubbles in a pressure chamber is detected. Here, a voltage that is applied to a piezoelectric element during measurement of the resonance frequency of the piezoelectric element is ordinarily a voltage which is significantly lower than a voltage that is applied to the piezoelectric element to cause ejection of ink (for example, if the voltage applied for ink ejection is 30 to 40 V, the measurement voltage might be around 0.5 V).

However, even if the inspections described above are carried out during fabrication of printer devices and/or during distribution, and it has been confirmed for the recording heads in the printer devices that resonance frequencies of individual piezoelectric elements are contained within a certain range, during continuing use of the printer device, there may be faults or significant changes in characteristics at some of the piezoelectric elements over time. Piezoelectric elements that break down or undergo major changes in characteristics over time (that is, short-lifespan piezoelectric elements) are thought to result from slight faults in joining conditions during fabrication of the recording head, or the inclusion of slight cracks. However, in conventional inspection of a recording head, it is difficult to detect piezoelectric elements that will break down or exhibit major changes in characteristics over time, even if a threshold value for the resonance frequency is adjusted, and thus the accuracy of the inspection is actually insufficient.

SUMMARY OF THE INVENTION

The present invention has been devised in consideration of the circumstances described above, and will provide a liquid ejection head inspection method which is capable of suppressing occurrences of breakdowns over time and the like in piezoelectric elements provided at a liquid ejection head, and a printer device.

Impedances of piezoelectric elements employed in a recording head (a liquid ejection head) vary in accordance with the magnitudes of voltages that are applied. The inventor of the present application have considered the circumstances described above, and have performed an experiment of respectively applying a voltage conventionally used in the inspection and a voltage higher than the conventional voltage (specifically, a voltage whose magnitude is substantially the same as that when ink is to be ejected from the liquid ejection head) to individual piezoelectric elements of a liquid ejection head, measuring respective frequency characteristics of impedance of the individual piezoelectric elements, and determining resonance frequencies of the individual piezoelectric elements. Results are shown in FIG. 1A. Here, the horizontal axis of FIG. 1A represents positions in the liquid ejection head of nozzles that correspond to the individual piezoelectric elements. As can be clearly seen from FIGS. 1A and 1B, when the voltage higher than in convention is applied to the piezoelectric elements, variations in resonance frequencies of the individual piezoelectric elements are larger.

Further, the inventor of the present application have performed an experiment of employing a liquid ejection head for which it has been confirmed by an inspection described above that there are no occurrences of faults in the individual piezoelectric elements, and driving this liquid ejection head continuously until it is ascertained that faults or major changes in characteristics have occurred at any portion of the piezoelectric elements provided at the liquid ejection head. Then, for the piezoelectric elements at which faults and the like occurred during the experiment, the resonance frequencies that were determined by applying the high voltage during the inspection are checked. The piezoelectric elements at which faults and the like occurred during the experiment have been found to be piezoelectric elements for which the resonance frequencies determined by applying the high voltage during the inspection were relatively low frequencies. As is shown in FIG. 1C, it has been ascertained that a degree of lowering of the resonance frequencies between the resonance frequencies determined at the times of application of the high voltage and the resonance frequencies determined at the times of application of the low voltage is larger in a piezoelectric element that has failed than in one that has not failed. On the basis of the facts described above, the inventor of the present application have determined that it is possible to detect a piezoelectric element which is likely to be susceptible to the occurrence of breakdown or the like over time by, during inspection of a liquid ejection head, respectively applying a low voltage (a conventionally used voltage) and a high voltage (for example, a voltage whose magnitude is substantially the same as that for when ink is to be ejected from the liquid ejection head), determining respective resonance frequencies, and comparing the two resonance frequencies. Thus, the present inventors have managed to devise the present invention.

In accordance with the above descriptions, a first aspect of the present invention is a method for inspecting of a liquid ejection head which is equipped with a plurality of nozzles at which piezoelectric elements are provided and which ejects recording liquid droplets from the individual nozzles in accordance with application of a driving signal voltage to the individual piezoelectric elements, the method including: applying a first voltage to each individual piezoelectric element for measuring a resonance frequency of the individual piezoelectric element; applying a second voltage, which is higher than the first voltage, to the individual piezoelectric element for measuring a resonance frequency of the individual piezoelectric element; and on the basis of the resonance frequencies at the times of application of the first voltage and the resonance frequencies at the times of application of the second voltage, detecting piezoelectric elements that are likely to be susceptible to failure over time.

In the first aspect of the present invention, for the liquid ejection head at which the plural nozzles at which the piezoelectric elements are provided are equipped and which ejects recording liquid droplets from the individual nozzles in accordance with the application of the driving signal voltage to the individual piezoelectric elements, the first voltage is applied respectively to the individual piezoelectric elements of the liquid ejection head and resonance frequencies are measured, and the second voltage, which is higher than the first voltage, is applied respectively to the individual piezoelectric elements and resonance frequencies are measured.

A second aspect of the present invention is a printer device provided with a liquid ejection head which is equipped with a plurality of nozzles at which piezoelectric elements are provided and which ejects recording liquid droplets from the individual nozzles in accordance with application of a driving signal voltage to the individual piezoelectric elements, the printer device including: a storage section that stores information representing piezoelectric elements that are likely to be susceptible to failure over time, which have been detected by a predetermined method for inspecting the liquid ejection head; and a driving control section that controls driving of the liquid ejection head so as to reduce frequencies of occurrence of driving of the piezoelectric elements that are likely to be susceptible to failure over time, on the basis of the information stored at the storage section, wherein the method for inspecting the liquid ejection head includes: applying a first voltage to each individual piezoelectric element for measuring a resonance frequency of the individual piezoelectric element; applying a second voltage, which is higher than the first voltage, to each individual piezoelectric element for measuring a resonance frequency of the individual piezoelectric element; and on the basis of the resonance frequencies at the times of application of the first voltage and the resonance frequencies at the times of application of the second voltage, detecting the piezoelectric elements that are likely to be susceptible to failure over time.

In the second aspect of the present invention, the information representing the piezoelectric elements that are expected to be susceptible to faults over time, which have been detected by the liquid ejection head inspection method of the first aspect, is stored at the storage section. The driving control section controls driving of the liquid ejection head in accordance with the information stored in the storage section, so as to lower frequencies of occurrence of driving of the piezoelectric elements for which susceptibility to failure over time is anticipated. Thus, it is possible to suppress occurrences of breakdowns and the like over time of the piezoelectric elements provided at the liquid ejection head.

A third aspect of the present invention is a printer device provided with a liquid ejection head which is equipped with a plurality of nozzles at which piezoelectric elements are provided and which ejects recording liquid droplets from the individual nozzles in accordance with application of a driving signal voltage to the individual piezoelectric elements, the printer device including: a measurement section that applies a first voltage to each individual piezoelectric element for measuring a resonance frequency of the individual piezoelectric element and applies a second voltage, which is higher than the first voltage, to the individual piezoelectric element for measuring a resonance frequency of the individual piezoelectric element; a detection section that detects piezoelectric elements that are likely to be susceptible to failure over time, on the basis of the resonance frequencies at the times of application of the first voltage and the resonance frequencies at the times of application of the second voltage, which have been measured by the measurement section; a storage section that stores information representing the piezoelectric elements that are likely to be susceptible to failure over time, which have been detected by the detection section; and a driving control section that controls driving of the liquid ejection head so as to reduce frequencies of occurrence of driving of the piezoelectric elements that are likely to be susceptible to failure over time, on the basis of the information stored at the storage section.

At the printer device of the third aspect of the present invention, the measurement section is provided. The measurement section respectively applies the first voltage to the individual piezoelectric elements and measures the resonance frequencies, and respectively applies the second voltage, which is higher than the first voltage, to the individual piezoelectric elements and measures the resonance frequencies. On the basis of the resonance frequencies measured when the first voltage applied by the measurement section and the resonance frequencies measured when the second voltage applied, the detection section detects the piezoelectric elements that are expected to be susceptible to faults over time. The storage section stores the information representing the piezoelectric elements for which susceptibility to failure over time is anticipated, which have been detected by the detection section. Hence, the driving control section controls driving of the liquid ejection head in accordance with the information stored in the storage section so as to lower frequencies of occurrence of driving of the piezoelectric elements that are likely to be susceptible to failure over time. Thus, similarly to the second aspect, it is possible to suppress occurrences of breakdowns and the like over time of the piezoelectric elements provided at the liquid ejection head.

According to the structures described above, the present invention has an excellent effect in that it is possible to suppress occurrences, over time, of faults and the like in piezoelectric elements provided at a liquid ejection head.

BRIEF DESCRIPTION OF THE DRAWINGS

Embodiments of the present invention will be described in detail based on the following figures, wherein:

FIG. 4A is a graph showing a waveform of a second measurement voltage without a bias voltage applied;

FIG. 4B is a graph showing a waveform of the second measurement voltage with a bias voltage applied;

FIG. 4C is a graph showing another example of a waveform of the second measurement voltage;

DETAILED DESCRIPTION OF THE INVENTION

Figure 1A:
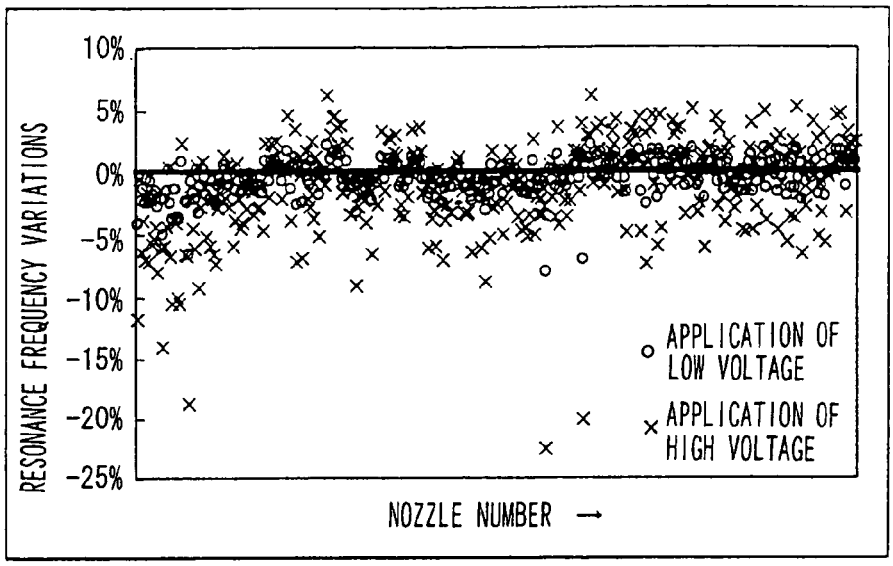
FIG. 1A is a graph showing results when two levels of voltage are respectively applied to individual piezoelectric elements of a liquid ejection head and resonance frequencies are measured.
Figure 1B:
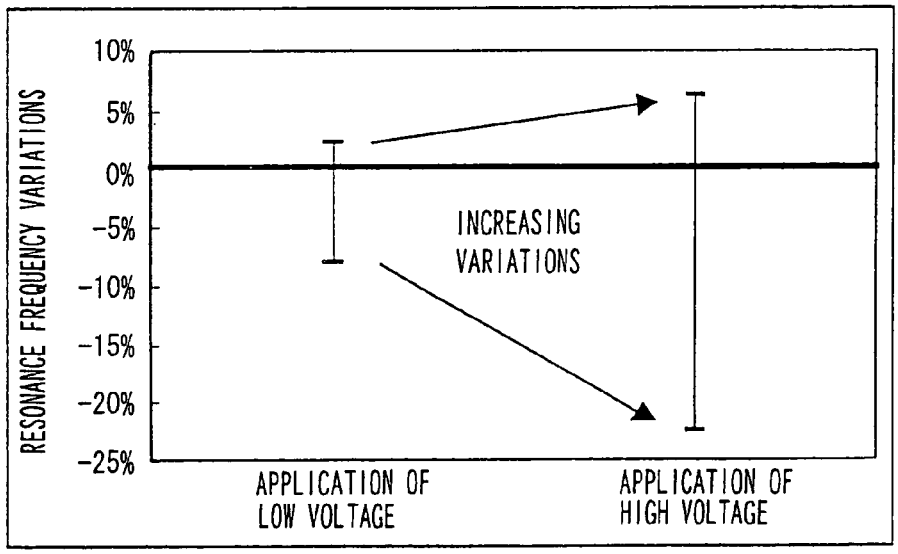
FIG. 1B is a graph illustrating a relationship between the applied voltages of FIG. 1A and variations in the resonance frequencies.
Figure 1C:
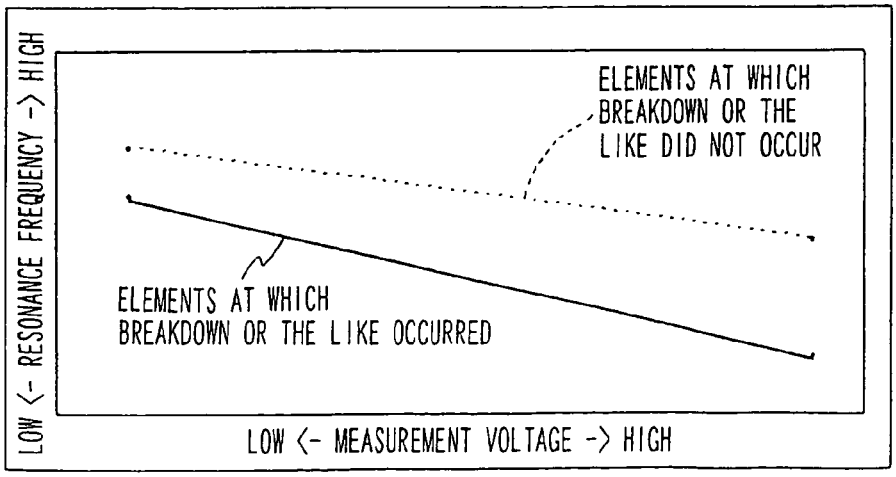
FIG. 1C is a graph showing a difference, between piezoelectric elements at which faults and the like occur during continuous driving of a liquid ejection head and piezoelectric elements at which faults and the like do not occur, in a gradient of change in resonance frequency with respect to variation of an applied voltage.

In a liquid ejection head inspection method according to the present invention, at a liquid ejection head which is equipped with plural nozzles at which piezoelectric elements are provided and which ejects recording liquid droplets from the individual nozzles in accordance with the application of a driving signal voltage to the individual piezoelectric elements, a first voltage is respectively applied to the individual piezoelectric elements and resonance frequencies are measured, a second voltage, which is higher than the first voltage, is respectively applied to the individual piezoelectric elements and resonance frequencies are measured and, on the basis of the resonance frequencies at the times of application of the first voltage and the resonance frequencies at the times of application of the second voltage, detects piezoelectric elements which are likely to be susceptible to failure over time.

Herein, a magnitude (any of a maximum voltage, an average voltage, and an effective voltage) of the second voltage may be a magnitude which is substantially equal to the driving signal voltage (a voltage which is applied to a piezoelectric element when a recording liquid droplet is to be ejected from a nozzle), and a magnitude (any of a maximum voltage, an average voltage, and an effective voltage) of the first voltage may be a magnitude which is smaller than the driving signal voltage by at least a predetermined value. Further, voltages whose magnitudes vary cyclically with certain amplitudes may be employed as the first voltage and the second voltage. Thus, measurement of the resonance frequencies may be performed by repeatedly measuring current flowing through a piezoelectric element while altering the frequency of the first voltage or second voltage being applied to the piezoelectric element, determining a frequency characteristic of impedance of the piezoelectric element, and deducing a resonance frequency from the thus-obtained frequency characteristic of impedance.

Further, with the liquid ejection head inspection method according to the present invention, piezoelectric elements that are expected to be susceptible to failure over time are detected on the basis of the resonance frequencies at the times of application of the first voltage and the resonance frequencies at the times of application of the second voltage. Specifically, detection of piezoelectric elements that are likely to be susceptible to failure over time may be performed by calculating, for the individual piezoelectric elements, reduction ratios of the resonance frequencies at the times of application of the second voltage relative to the resonance frequencies at the times of application of the first voltage, and determining that piezoelectric elements for which the reduction ratio of the resonance frequencies is greater than or equal to a threshold value are piezoelectric elements which are likely to be susceptible to failure over time. Alternatively, it is possible to instead calculate reduction amounts of the resonance frequencies at the times of application of the second voltage relative to the resonance frequencies at the times of application of the first voltage, and determine that piezoelectric elements for which the reduction amount of the resonance frequencies is greater than or equal to a threshold value are piezoelectric elements which are likely to be susceptible to failure over time. As has been described hereabove, according to the experiment conducted by the inventor of the present application, it has been ascertained that piezoelectric elements which are likely to be susceptible to failure over time, due to, for example, slight faults in joining conditions during fabrication of a liquid ejection head, the inclusion of slight cracks or the like, exhibit a greater degree of lowering between a resonance frequency when a higher voltage is applied and a resonance frequency when a lower voltage is applied (i.e., a greater difference between a resonance frequency when a higher voltage is applied and a resonance frequency when a lower voltage is applied) than normal piezoelectric elements. Therefore, using resonance frequencies at the times of application of the first voltage and resonance frequencies at the times of application of the second voltage as described above, it is possible to detect piezoelectric elements which are likely to be susceptible to failure over time with high accuracy.

Thus, when the presence, among plural piezoelectric elements provided at a liquid ejection head which is the subject of inspection, of a piezoelectric element which is expected to be susceptible to failure over time is detected, it is possible to implement countermeasures such as, for example, stopping distribution of that liquid ejection head (excluding the liquid ejection head from heads to be installed in printer devices that are to be distributed), replacing the piezoelectric element that is expected to be susceptible to failure over time, controlling driving of the liquid ejection head such that a frequency of occurrence of driving of the piezoelectric element that is expected to be susceptible to failure over time is lowered, or the like. Thus, it is possible to avoid the occurrence of breakdowns over time and the like of the piezoelectric element provided at the liquid ejection head. Accordingly, it is possible to suppress occurrences of breakdowns and the like over time of piezoelectric elements provided at liquid ejection heads.

Now, in a case in which a voltage whose magnitude cyclically varies with a certain amplitude is employed as the first voltage or second voltage to be applied to the individual piezoelectric elements at times of measurement of resonance frequencies, if the amplitude of the voltage is small (for example, 1 V), there will be no adverse effects on the piezoelectric elements even if the applied voltage is bipolar. However, if the amplitude of the voltage is large, there is some fear that the piezoelectric elements may be damaged. Therefore, at least when the second voltage is to be applied and a resonance frequency measured, it is preferable to apply a voltage in which a bias voltage is added to the piezoelectric element, so that the polarity of the voltage applied to the piezoelectric element will be constant through a measurement period. As a result, at least during a period of application of the second voltage, temporary switching of the polarity of the voltage applied to the piezoelectric element will be avoided, and it will be possible to avoid adverse effects on the piezoelectric element. Further, when the first voltage is to be applied and a resonance frequency measured, a voltage to which a bias voltage has been added to the piezoelectric element can be applied, so that the polarity of the voltage applied to the piezoelectric element will be constant through a period of measurement.

Further again, it is preferable to add a recording device which enables reading and writing of information to the liquid ejection head, and to write the results of detection of piezoelectric elements that are expected be susceptible to failure over time to the recording device. When a recording device is added to a liquid ejection head which is usually installed in a printer device for use, and the detection results of piezoelectric elements that are likely to be susceptible to failure over time as described above are preparatory written to the recording device, these detection results can be acquired even in a state in which the liquid ejection head has been removed from the printer device. Accordingly, even in a case in which a liquid ejection head is removed from a printer device and re-used or the like, it is possible to easily acquire the above-mentioned detection results by reading from the recording device. Thus, it is possible, by controlling driving of the liquid ejection head on the basis of these acquired detection results so as to reduce frequencies of driving of the piezoelectric elements that are expected to be susceptible to failure over time, to simply realize avoidance of the occurrence of breakdowns and the like over time of the piezoelectric elements provided in the liquid ejection head.

Further still, the present invention can realize a printer device which implements inspections according to the liquid ejection head inspection method described above with a measurement section and a detection section, and which controls driving of the liquid ejection head on the basis of inspection information from the inspections so as to reduce frequencies of driving of piezoelectric elements that are likely to be susceptible to failure over time.

At this printer device, it is preferable to have a structure which periodically (for example, when a power supply of the printer device is turned on or off, at times of maintenance of the printer device, and/or when the printer device is in standby (i.e., when no printing processing is being performed)) measures the resonance frequencies at the times of application of the first voltage and resonance frequencies at the times of application of the second voltage with the measurement section and implements detection of piezoelectric elements that are likely to be susceptible to faults over time with the detection section. Consequently, even in a case in which conditions of any portion of the piezoelectric elements of the liquid ejection head change during continuing use of the printer device, or the like, it is possible to detect changes in the conditions of that portion of the piezoelectric elements and to avoid the occurrence of faults and the like over time in the portion of the piezoelectric elements whose conditions are changing.

Further, the present invention can also realize a printer device which stores information representing the piezoelectric elements that are likely to be susceptible to failure over time, which have been detected by the liquid ejection head inspection method described above, in a storage section and which, on the basis of the information stored in the storage section, controls driving of the liquid ejection head so as to lower frequencies of occurrence of driving of the piezoelectric elements that are likely to be susceptible to breakdown over time.

Figure 2:
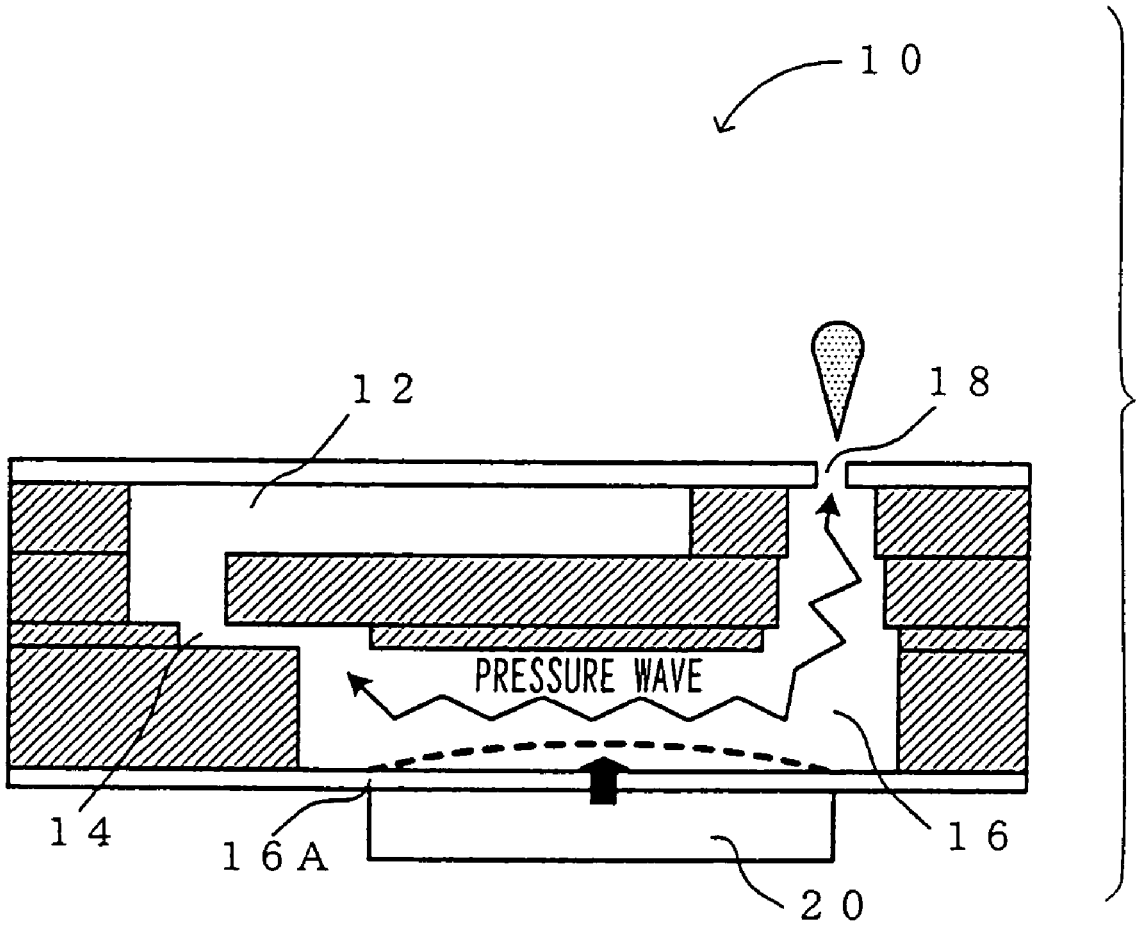
FIG. 2 is a sectional view showing internal structure of a liquid ejection head.

Herebelow, an example of an embodiment of the present invention will be described in detail with reference to the drawings. FIG. 2 shows interior structure of a liquid ejection head 10 of an inkjet printer device to which the present invention can be applied. Here, although the liquid ejection head 10 is provided with a large number of nozzles, the individual nozzles have the same structure as one another, and FIG. 2 only shows a portion corresponding to a single nozzle.

As shown in FIG. 2, an ink tank 12 is provided in the liquid ejection head 10. Ink, which is supplied through an unillustrated ink supply channel, is stored in this ink tank 12. The ink tank 12 is communicated with a pressure chamber 16 via a supply channel 14, and the pressure chamber 16 is charged with ink supplied from the ink tank 12 through the supply channel 14. A portion of a wall face of the pressure chamber 16 is constituted by an oscillation diaphragm 16A, and a piezoelectric element 20 is joined to this oscillation diaphragm 16A by adhesion or the like. When a voltage (below referred to as a driving signal voltage) is applied to the piezoelectric element 20, the piezoelectric element 20 is displaced. Therefore, the oscillation diaphragm 16A oscillates, and the oscillation of the oscillation diaphragm 16A is propagated through the pressure chamber 16 in the form of a pressure wave. Thus, ink in the pressure chamber 16 is ejected as an ink droplet through a nozzle 18, which is communicated with the pressure chamber 16.

26

Figure 3:
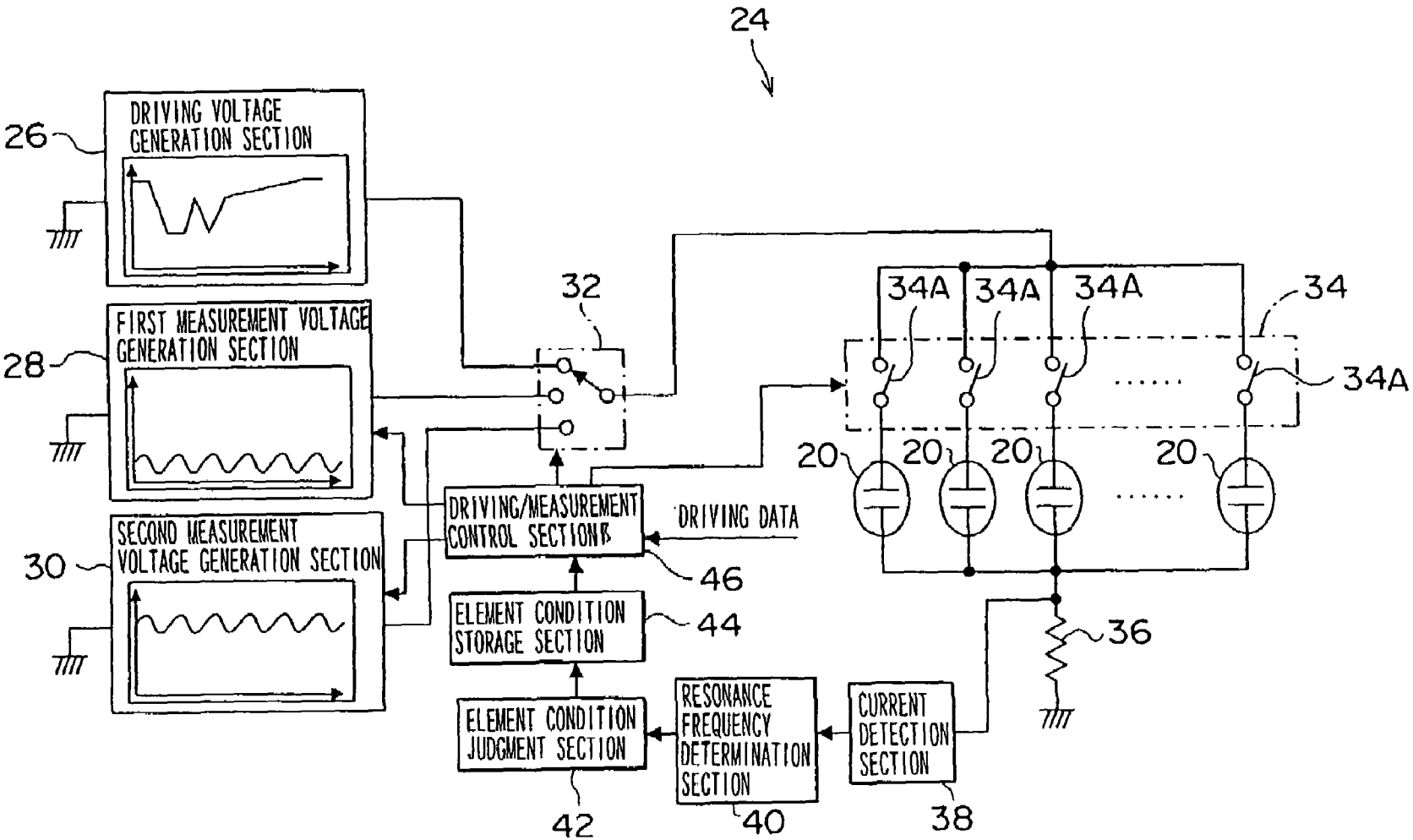
FIG. 3 is a schematic block view showing structure of a driving section which drives the liquid ejection head.

FIG. 3 shows an inspection/driving section 24, which performs inspection and driving of the liquid ejection head 10. The inspection/driving section 24 may be mounted at an inspection apparatus which carries out an inspection of the liquid ejection head 10 during a process of fabrication of the liquid ejection head 10, during distribution of an inkjet printer device or the like, or at an inkjet printer device to which the liquid ejection head 10 is assembled. The inspection/driving section 24 is equipped with a driving voltage generation section 26, which generates driving signal voltages for driving the piezoelectric elements 20 (being applied to the piezoelectric elements 20) so as to eject ink droplets from the nozzles 18 of the liquid ejection head 10. The driving voltage generation section 26 generates a driving signal voltage by generating a signal with a specified waveform and amplifying this signal up to a predetermined voltage, so as to eject an ink droplet (a recording liquid droplet) with a predetermined droplet volume from the nozzle 18 at a predetermined droplet speed while suppressing the ejection of ink droplets other than the recording liquid droplet (extraneous satellite droplets, mist and the like). In the present embodiment, a magnitude (a maximum voltage) of the driving signal voltage is set to, for example, around 30 to 40 V.

The inspection/driving section 24 is also provided with a first measurement voltage generation section 28 and a second measurement voltage generation section 30. The first measurement voltage generation section 28 generates a first measurement voltage for application to one of the piezoelectric elements 20 when a resonance frequency of the piezoelectric element 20 is to be measured, and similarly, the second measurement voltage generation section 30 generates a second measurement voltage for application to the piezoelectric element 20 for measurement of a resonance frequency. For the first measurement voltage, the first measurement voltage generation section 28 cyclically varies the magnitude of a voltage with a certain amplitude, and generates a voltage whose maximum voltage is smaller than the driving signal voltage by at least a predetermined value (for example, smaller by around 0.5 V). For the second measurement voltage, the second measurement voltage generation section 30 cyclically varies the magnitude of a voltage with a certain amplitude, and generates a voltage whose maximum voltage is about the same as the driving signal voltage (for example, around 30 to 40 V). Herein, in FIG. 3, the first measurement voltage and the second measurement voltage are shown with sinusoidal waveforms. However, this is not a limitation; for example, cosine waves could be employed.

Now a case is considered in which, consequent to specification of an amplitude and a bias voltage of a measurement voltage to be applied to the piezoelectric element 20, a reverse polarity voltage is applied to the piezoelectric element 20 for some periods in a period of application of the measurement voltage, for example, as is shown in FIG. 4A. In such a case, particularly in the second measurement voltage, which is a higher application voltage, is being applied and the polarity of the voltage is temporarily switching, there is a possibility of adverse effects which will damage the piezoelectric element 20 or the like acting on the piezoelectric element 20. Therefore, after generating a voltage in which the magnitude of the voltage varies cyclically with a certain amplitude, the second measurement voltage generation section 30 adds a bias voltage $V_B$ to the generated voltage such that the polarity of the voltage to be applied to the piezoelectric element 20 is constant through the period of application of the second measurement voltage (i.e., such that the polarity of the second measurement voltage does not temporarily switch), for example, as is shown in FIG. 4B. Thus, the second measurement voltage generation section 30 is structured so as to generate a second measurement voltage whose maximum voltage is about the same as the maximum voltage of the driving signal voltage (for example, around 30 to 40 V).

The first measurement voltage generation section 28 and the second measurement voltage generation section 30 are made to be capable of varying frequencies of the first measurement voltage and the second measurement voltage in a range of, for example, about 1 kHz to about 1 MHz. The first measurement voltage generation section 28 and the second measurement voltage generation section 30 are connected to a driving/measurement control section 46, and vary the frequencies of the first measurement voltage and the second measure voltage in accordance with instructions from the driving/measurement control section 46.

The driving voltage generation section 26, the first measurement voltage generation section 28 and the second measurement voltage generation section 30 are respectively connected to a selection section 32. The driving signal voltage, the first measurement voltage and the second measurement voltage are respectively inputted to the selection section 32. The selection section 32 is also connected to the driving/measurement control section 46. In FIG. 3, the selection section 32 is shown schematically as a switch. However, in practice the selection section 32 has a structure which includes semiconductor switching devices, such as MOSFETs or the like. In accordance with instructions from the driving/measurement control section 46, the selection section 32 selectively outputs any of the inputted driving signal voltage, first measurement voltage and second measurement voltage.

A switching section 34 is equipped with a number of switching devices 34A equal to the number of piezoelectric elements 20 provided at the liquid ejection head 10. An output terminal of the selection section 32 is respectively connected to one terminal of each of the switching devices 34A of the switching section 34. The individual switching devices 34A of the switching section 34 are also constituted by semiconductor switching devices such as MOSFETS or the like. The individual switching devices 34A are controlled to be turned on and off by the driving/measurement control section 46. Another terminal of each individual switching device 34A is connected to one terminal of each individual piezoelectric element 20 of the liquid ejection head 10. Another terminal of each of the piezoelectric elements 20 is connected to ground via a resistor for current detection 36.

The piezoelectric elements 20 are also connected, between the piezoelectric elements 20 and the resistor for current detection 36, to a current detection section 38. Magnitudes of currents flowing through the resistor for current detection 36 are detected by the current detection section 38. An output terminal of the current detection section 38 is connected to a resonance frequency determination section 40, an element condition judgment section 42, an element condition storage section 44 and the driving/measurement control section 46, in that order. On the basis of current values detected by the current detection section 38, the resonance frequency determination section 40 determines frequency characteristics of impedance (more specifically, admittance, which is the inverse of impedance) of the individual piezoelectric elements 20, and deduces resonance frequencies (a resonance frequency at the time of application of the first measurement voltage (a first resonance frequency) and a resonance frequency at the time of application of the second measurement voltage (a second resonance frequency)) from the frequency characteristics of impedance (admittance) that have been determined for each individual piezoelectric element 20.

The element condition judgment section 42 judges conditions of the individual piezoelectric elements 20 on the basis of the first resonance frequencies and second resonance frequencies deduced by the resonance frequency determination section 40, and the element condition storage section 44 stores judgment results from the element condition judgment section 42. Herein, the element condition storage section 44 may employ a non-volatile memory such as, for example, a flash memory or the like. When an inspection of the individual piezoelectric elements 20 of the liquid ejection head 10 is to be carried out, the driving/measurement control section 46 controls the selection section 32 and the switching section 34 so as to sequentially apply the first measurement voltage and the second measurement voltage to the individual piezoelectric elements 20 of the liquid ejection head 10. When ink is to be ejected from the liquid ejection head 10 to record an image on a recording sheet, the driving/measurement control section 46 controls the selection section 32 and the switching section 34 so as to apply the driving signal voltage to the individual piezoelectric elements 20 of the liquid ejection head 10 in accordance with driving data which is inputted from outside (i.e., driving data for causing ink droplets to be ejected from the respective nozzles 18 of the liquid ejection head 10 such that a predetermined image is recorded at the recording sheet).

Figure 5:
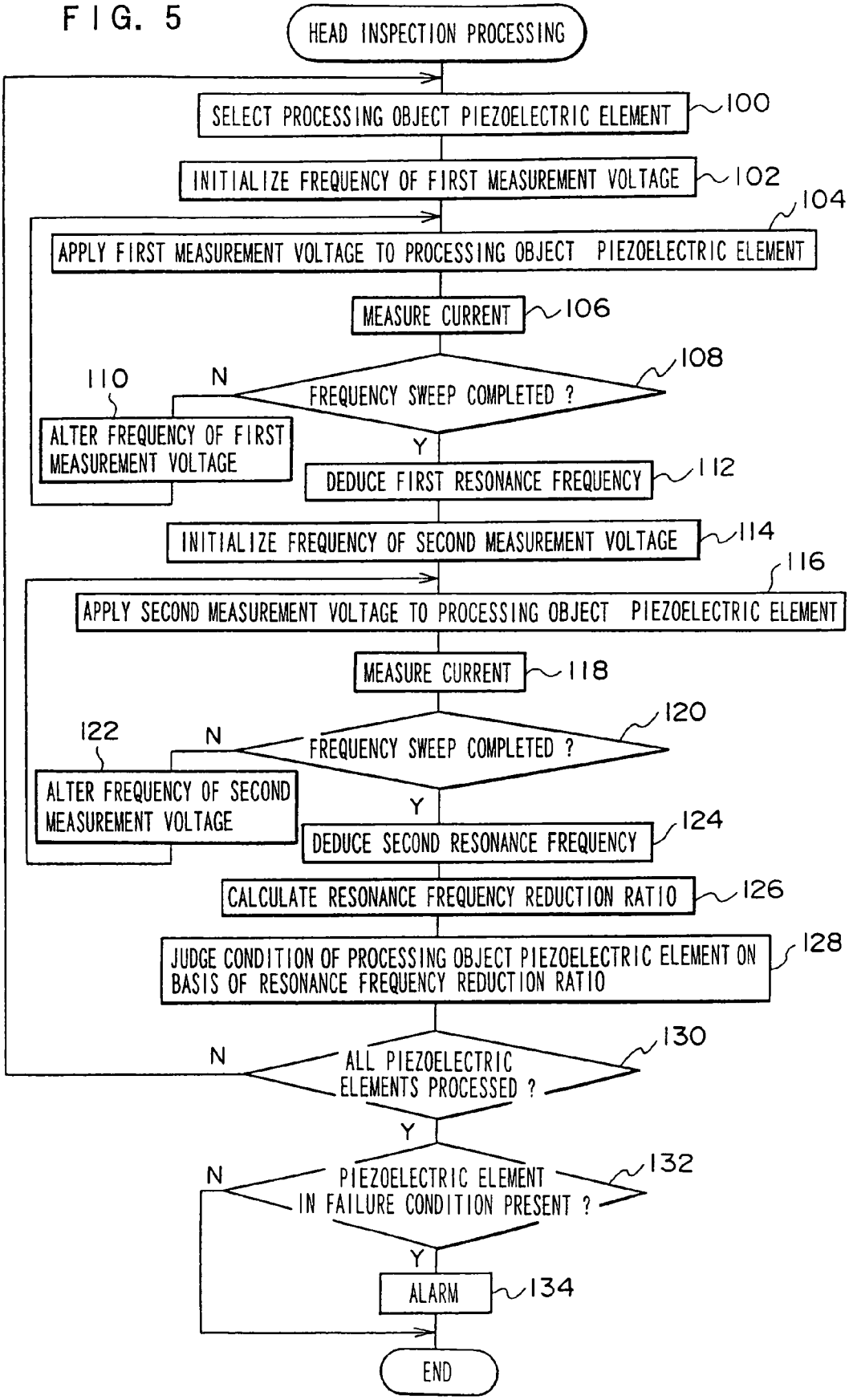
FIG. 5 is a view showing a flowchart representing details of a head inspection process.

Next, head inspection processing which is executed by the inspection/driving section 24 will be described with reference to FIG. 5, as an operation of the present embodiment. Here, the inspection/driving section 24 can be incorporated in an inspection apparatus and this head inspection processing can be executed by the inspection/driving section 24 during a process of fabrication of the liquid ejection head 10, at a time of distribution of an inkjet printer device or the like. Further, the inspection/driving section 24 can be mounted at the inkjet printer device and, after an inkjet printer device in which the liquid ejection head 10 is installed has been distributed, this head inspection processing can be executed by the inspection/driving section 24 when the inkjet printer device is turned on (and/or turned off), at times of maintenance of the inkjet printer device, and/or at standby times when the inkjet printer device is not performing printing processing. Note that the inkjet printer device at which the inspection/driving section 24 is mounted corresponds to the printer device of the third aspect of the present invention.

In the head inspection processing, first, one of the piezoelectric elements 20, which is to be an object of the processing, is selected by the driving/measurement control section 46 from the numerous piezoelectric elements 20 provided at the liquid ejection head 10 (step 100). Next, the driving/measurement control section 46 controls the first measurement voltage generation section 28 (step 102) to set a frequency of the first measurement voltage that is outputted from the first measurement voltage generation section 28 to a predetermined initial value (for example, a frequency value corresponding to an upper limit or a lower limit of a range of alteration of the frequency of the first measurement voltage in the head inspection processing). Then, the driving/measurement control section 46 controls the selection section 32 such that the selection section 32 outputs the first measurement voltage that is outputted from the first measurement voltage generation section 28, and controls the switching section 34 such that, among the numerous switching devices 34A provided in the switching section 34, only the switching device 34A corresponding to the processing object piezoelectric element 20 is switched on (step 104). As a result, the first measurement voltage outputted from the selection section 32 is applied only to the processing object piezoelectric element 20.

When the first measurement voltage is applied to the processing object piezoelectric element 20, the current detection section 38 measures the magnitude of a current flowing through the resistor for current detection 36, and thus a current flowing through the processing object piezoelectric element 20 (step 106). Herein, current values measured by the current detection section 38 are inputted to the resonance frequency determination section 40 and are held at the resonance frequency determination section 40. When the current measurement is completed, the driving/measurement control section 46 determines whether or not the frequency of the first measurement voltage has been varied across the whole of a predetermined frequency alteration range (step 108). If this determination is negative, the driving/measurement control section 46 controls the first measurement voltage generation section 28 to alter the frequency of the first measurement voltage being outputted from the first measurement voltage generation section 28 by a predetermined value (step 110). Then, application of the first measurement voltage to the processing object piezoelectric element 20 and current measurement (steps 104 and 108) are repeated.

Figure 6:
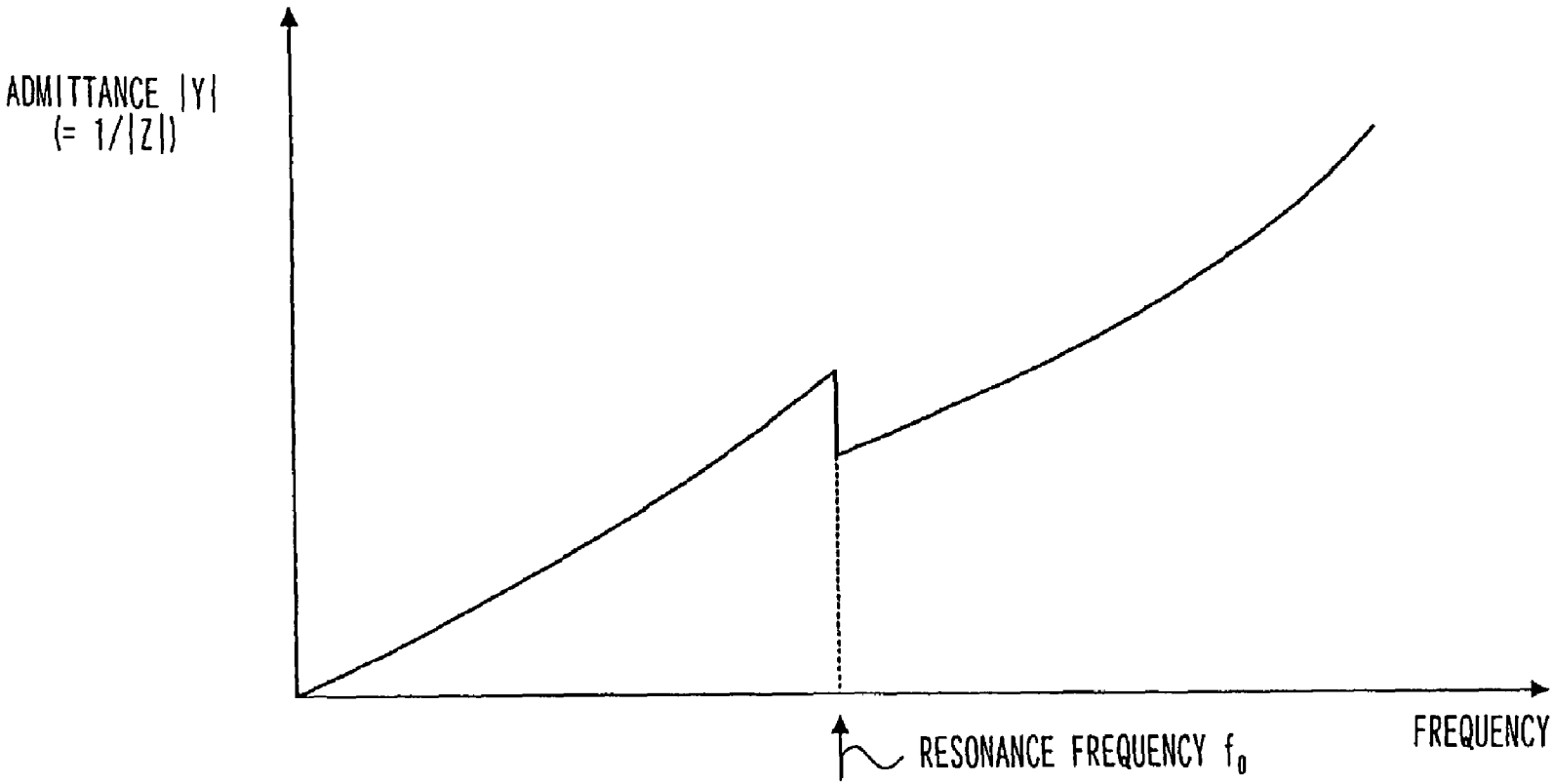
FIG. 6 is a graph showing an example of a resonance frequency characteristic of admittance (and hence impedance) of a piezoelectric element.

When the frequency of the first measurement voltage has been varied across the whole of the predetermined frequency alteration range and currents have been respectively measured for application of the first measurement voltage at each frequency to the processing object piezoelectric element 20 (i.e., when the determination of step 108 is affirmative), the resonance frequency determination section 40 calculates respective admittances |Y| (inverse of impedances |Z|) for the respective values of frequency of the first measurement voltage, on the basis of the current values inputted from the current detection section 38 and held at the resonance frequency determination section 40. Hence, as is shown in FIG. 6, for example, a frequency characteristic of admittance |Y| of the processing object piezoelectric element 20 at the times of application of the first measurement voltage is determined, and a frequency at a point in the determined frequency characteristic at which the admittance |Y| changes sharply (the resonance frequency $f_0$ in FIG. 6) is deduced to be a resonance frequency at the time of application of the first measurement voltage to the processing object piezoelectric element 20 (a first resonance frequency $f_L$) (step 112).

Note that the steps 102 to 112 described above correspond to the step of "applying a first voltage to each individual piezoelectric element for measuring a resonance frequency of the individual piezoelectric element" of the first aspect of the present invention, and the first measurement voltage generation section 28, selection section 32, switching section 34, current detection section 38, resonance frequency determination section 40 and driving/measurement control section 46 that implement the processing described above correspond to the measurement section of the third aspect of the present invention.

Subsequently, the driving/measurement control section 46 controls the second measurement voltage generation section 30 so as to set a frequency of the second measurement voltage that is outputted from the second measurement voltage generation section 30 to a predetermined initial value (step 114). Then, the driving/measurement control section 46 controls the selection section 32 such that the selection section 32 outputs the second measurement voltage that is outputted from the second measurement voltage generation section 30 and controls the switching section 34 such that, among the numerous switching devices 34A provided in the switching section 34, only the switching device 34A corresponding to the processing object piezoelectric element 20 is switched on (step 116). As a result, the second measurement voltage outputted from the selection section 32 is applied only to the processing object piezoelectric element 20.

When the second measurement voltage is applied to the processing object piezoelectric element 20, the current detection section 38 measures the magnitude of a current flowing through the resistor for current detection 36, and thus a current flowing through the processing object piezoelectric element 20 (step 118). When the current measurement is completed, the driving/measurement control section 46 determines whether or not the frequency of the second measurement voltage has been varied across the whole of a predetermined frequency alteration range (step 120). If this determination is negative, the driving/measurement control section 46 controls the second measurement voltage generation section 30 to alter the frequency of the second measurement voltage being outputted from the second measurement voltage generation section 30 by a predetermined value (step 122). Then, application of the second measurement voltage to the processing object piezoelectric element 20 and current measurement (steps 116 and 118) are repeated.

When the frequency of the second measurement voltage has been varied across the whole of the predetermined frequency alteration range and currents have been respectively measured for application of the second measurement voltage at each frequency to the processing object piezoelectric element 20 (i.e., when the determination of step 120 is affirmative), the resonance frequency determination section 40 calculates respective admittances |Y| (inverse of impedances |Z|) for the respective values of frequency of the second measurement voltage, on the basis of the current values inputted from the current detection section 38 and held at the resonance frequency determination section 40. Hence, a frequency characteristic of admittance |Y| of the processing object piezoelectric element 20 at the times of application of the second measurement voltage is determined, and a frequency at which the admittance |Y| changes sharply in the determined frequency characteristic is deduced to be a resonance frequency at the time of application of the second measurement voltage to the processing object piezoelectric element 20 (a second resonance frequency $f_H$) (step 124).

Note that the steps 114 to 124 described above correspond to the step of "applying a second voltage, which is higher than the first voltage, to each individual piezoelectric element for measuring a resonance frequency of the individual piezoelectric element" of the first aspect of the present invention, and the second measurement voltage generation section 30, selection section 32, switching section 34, current detection section 38, resonance frequency determination section 40 and driving/measurement control section 46 that implement the processing described above correspond to the measurement section of the third aspect of the present invention.

The first resonance frequency $f_L$ and second resonance frequency $f_H$ that have been deduced by the resonance frequency determination section 40 are respectively inputted to the element condition judgment section 42. On the basis of the first resonance frequency $f_L$ and the second resonance frequency $f_H$, the element condition judgment section 42 calculates a resonance frequency reduction ratio Ra in accordance with the following equation (step 126).

$$Ra=(f_L-f_H)\div f_L\times 100$$

Then, the resonance frequency determination section 40 respectively compares the calculated resonance frequency reduction ratio Ra with threshold values $Ra_0$ and $Ra_1$ (here, the threshold value $Ra_0$ is less than the threshold value $Ra_1$ and, for example, the threshold value $Ra_0$ may be set to 15% and the threshold value $Ra_1$ to 30%), and judges the condition of the processing object piezoelectric element 20 (step 128). If the calculated resonance frequency reduction ratio Ra is larger than the threshold value $Ra_1$, it can be judged that the processing object piezoelectric element 20 has failed due to, for example, a significant problem in the condition of joining of the processing object piezoelectric element 20 to the oscillation diaphragm 16A, the presence of significant cracks in the processing object piezoelectric element 20, or the like. Hence, the resonance frequency determination section 40 stores information indicating that the processing object piezoelectric element 20 is in a failure condition at the element condition storage section 44.

Further, if the above-calculated resonance frequency reduction ratio Ra is larger than the threshold value $Ra_0$ but less than or equal to the threshold value $Ra_1$, it can be judged that the processing object piezoelectric element 20 is a piezoelectric element at which there is a high possibility of a breakdown or the like occurring over time, because of, for example, a slight problem in the condition of joining of the processing object piezoelectric element 20 to the oscillation diaphragm 16A, the presence of slight cracks in the processing object piezoelectric element 20, or the like (below, this kind of piezoelectric element 20 is referred to as a breakage-anticipated piezoelectric element). Hence, the resonance frequency determination section 40 stores information indicating that the processing object piezoelectric element 20 is a breakage-anticipated piezoelectric element at the element condition storage section 44.

Note that the steps 126 and 128 described above correspond to the step of "on the basis of the resonance frequencies at the times of application of the first voltage and the resonance frequencies at the times of application of the second voltage, detecting piezoelectric elements that are likely to be susceptible to failure over time" of the first aspect of the present invention, the element condition judgment section 42 that implements the processing described above corresponds to the detection section of the third aspect, and the element condition storage section 44 that stores the information mentioned above corresponds to the storage section of the third aspect.

Figure 7:
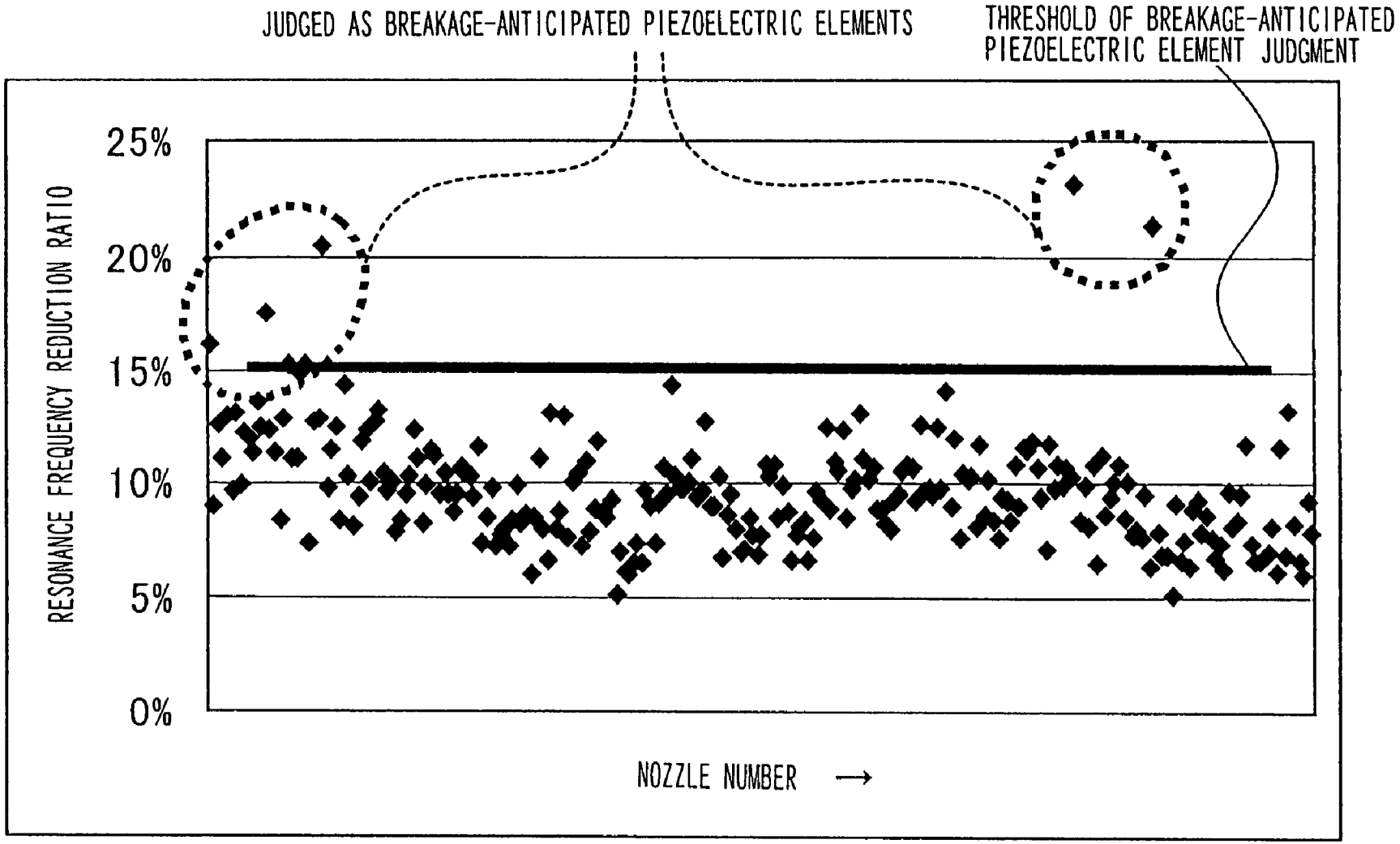
FIG. 7 is a graph showing an example of measurement results of reduction ratios of resonance frequencies and judgment of breakage-anticipated piezoelectric elements.

When the processing has been completed for one of the piezoelectric elements 20 as described above, it is determined whether or not the processing described above has been performed for all of the piezoelectric elements 20 provided at the liquid ejection head 10 (step 130). If this determination is negative, the processing described above (steps 100 to 130) is repeated for the unprocessed piezoelectric elements 20. Hence, as is shown in FIG. 7, for example, of the numerous piezoelectric elements 20 provided at the liquid ejection head 10, all of the piezoelectric elements 20 whose resonance frequency reduction ratios Ra are greater than $Ra_0$ can be respectively identified as piezoelectric elements in failure condition or breakage-anticipated piezoelectric elements. An example is shown in FIG. 7 in which 15% is employed as the threshold value $Ra_0$. However, this is not limited thereto, and the value of the threshold value $Ra_0$ can be altered appropriately.

When judgments of the presence or absence of a failure condition and judgments of whether or not there is a breakage-anticipated piezoelectric element have been carried out for all of the piezoelectric elements 20 provided in the liquid ejection head 10, the resonance frequency determination section 40 determines whether or not any of the piezoelectric elements 20 have been judged to be in a failure condition (step 132). If this determination is negative, the head inspection processing is finished without performing any further processing. However, if this determination is affirmative, alarm processing for giving notification that the piezoelectric element(s) 20 in the failure condition is present is performed (step 134). If such a case occurs in a process of fabrication of the liquid ejection head 10 or during distribution of an inkjet printer device, a response such as removing the liquid ejection head 10 that includes the piezoelectric element(s) 20 in the failure condition from distribution (excluding the liquid ejection head 10 from subjects of installation at inkjet printer devices that are to be distributed) or the like can be carried out by an operator who has observed this notification. If such a case occurs after distribution of an inkjet printer device, a response such as calling out a service technician or the like can be carried out by a user of the inkjet printer device who has observed this notification. Hence, the liquid ejection head 10 of the inkjet printer device can be replaced by the service technician.

If the liquid ejection head 10 has been confirmed to not include any piezoelectric elements 20 in the failure condition by the head inspection processing described above, in a process of fabrication of the liquid ejection head 10 or during distribution of an inkjet printer device, the liquid ejection head 10 is installed in the inkjet printer device and distributed regardless of whether or not any breakage-anticipated piezoelectric elements are included. If in a case of after distribution of an inkjet printer device, usage of the liquid ejection head 10 continues without performing of the alarm processing. However, when breakage-anticipated piezoelectric elements are included in the liquid ejection head 10, it can be judged that there is a high possibility of breakdowns or the like of those piezoelectric elements occurring in future.

Hence, when driving data is inputted from outside and ink is to be ejected from the liquid ejection head 10 in accordance with the inputted driving data to record an image on a recording sheet, the driving/measurement control section 46 first refers to the information stored in the element condition storage section 44 and determines whether or not any breakage-anticipated piezoelectric elements are included in the liquid ejection head 10. Then, if it is determined that there are no breakage-anticipated piezoelectric elements included at the liquid ejection head 10, the driving/measurement control section 46 causes the image to be recorded at the recording medium simply by controlling the selection section 32 and the switching section 34 in accordance with the inputted driving data. However, if it is determined that there are breakage-anticipated piezoelectric elements included at the liquid ejection head 10, the driving/measurement control section 46 alters the inputted driving data so as to reduce frequencies of occurrence of driving of the breakage-anticipated piezoelectric elements, and then uses the altered driving data to record the image at the recording sheet.

The reduction in frequency of the occurrence of driving of the breakage-anticipated piezoelectric elements may be implemented by, for example, in a case in which the inputted driving data is data which drives (i.e., causes the driving signal voltage to be applied to) the breakage-anticipated piezoelectric elements so as to eject small ink droplets over several separate times from the nozzles 18 corresponding to the breakage-anticipated piezoelectric elements, altering the data to drive the breakage-anticipated piezoelectric elements so as to instead eject a single large ink droplets only one time from the nozzles 18 corresponding to the breakage-anticipated piezoelectric elements, or the like. In consequence, the frequencies of driving of the breakage-anticipated piezoelectric elements included at the liquid ejection head 10 can be lowered, occurrences of faults and the like at the breakage-anticipated piezoelectric elements in short periods of time can be avoided, and a lengthening of lifespan of the breakage-anticipated piezoelectric elements can be realized.

Now, an example with the waveform in FIG. 4B serving as the waveform of the second measurement voltage which is generated by the second measurement voltage generation section 30 has been described hereabove. However, the present invention is not limited thus. A waveform with a larger amplitude, for example, as is shown in FIG. 4C, may be utilized. In such a case, the magnitude of the bias voltage $V_B$ which is added so that the polarity of the second measurement voltage will not temporarily switch is made smaller. While a second measurement voltage with a smaller amplitude, as shown in FIG. 4B, has a smaller possibility of exerting adverse effects on the piezoelectric elements, in a case with a second measurement voltage with a larger amplitude, as shown in FIG. 4C, an advantage is provided in that there is a higher possibility of improving accuracy of measurement of the second resonance frequency $f_H$.

Furthermore, an example in which the element condition storage section 44 is structured by a non-volatile memory has been described hereabove. This non-volatile memory may be added to the liquid ejection head 10 to serve as an RFID (Radio Frequency IDentification) tag which is equipped with functions for performing wireless communications (as for the recording device). As a result, even if the liquid ejection head 10 is removed from the inkjet printer device for re-use, it is possible, by reading information from the above-mentioned RFID tag by wireless communications, to easily determine breakage-anticipated piezoelectric elements among the piezoelectric elements of the liquid ejection head 10. Hence, by controlling driving of the liquid ejection head 10 so as to lower frequencies of driving of the breakage-anticipated piezoelectric elements, it is possible to avoid occurrences of faults and the like at the breakage-anticipated piezoelectric elements in short periods of time, and to easily realize the possibility of lengthening lifespans of the breakage-anticipated piezoelectric elements.

Moreover, an example in which an inkjet printer device at which the inspection/driving section 24 is installed serves as a printer device relating to the present invention has been described hereabove. However, the present invention is not limited thus. It is also possible to omit the first measurement voltage generation section 28, the second measurement voltage generation section 30, the selection section 32, the current detection section 38, the resonance frequency determination section 40 and the element condition judgment section 42, and to store information at the element condition storage section 44 which represents breakage-anticipated piezoelectric elements that have been detected by an inspection apparatus during a process of fabrication of the liquid ejection head 10 or during distribution of the inkjet printer device or the like. An inkjet printer device with this structure corresponds to the printer device of the second aspect of the present invention. In this aspect, although the emergence of new breakage-anticipated piezoelectric elements over time cannot be detected, it is possible to structure the inkjet printer device at lower cost.

What is claimed is:

1. A method for inspecting of a liquid ejection head which is equipped with a plurality of nozzles at which piezoelectric elements are provided and which ejects recording liquid droplets from the individual nozzles in accordance with application of a driving signal voltage to the individual piezoelectric elements, the method comprising:

applying a first voltage to each individual piezoelectric element for measuring a resonance frequency of the individual piezoelectric element;

applying a second voltage, which is higher than the first voltage, to the individual piezoelectric element for measuring a resonance frequency of the individual piezoelectric element; and on the basis of the resonance frequencies at the times of application of the first voltage and the resonance frequencies at the times of application of the second voltage, detecting piezoelectric elements that are likely to be susceptible to failure over time.

2. The liquid ejection head inspection method of claim 1, wherein the second voltage comprises a magnitude substantially the same as a magnitude of the driving signal voltage.

3. The liquid ejection head inspection method of claim 2, wherein the second voltage and the driving signal voltage comprise magnitudes from 30 to 40 V.

4. The liquid ejection head inspection method of claim 1, wherein the first voltage and second voltage that are applied to the individual piezoelectric elements at times of measurement of the resonance frequencies comprise voltages whose magnitudes vary cyclically with certain amplitudes, and measuring the resonance frequencies of each individual piezoelectric element comprises:

determining frequency characteristics of impedance of the piezoelectric element, by varying frequencies of the first voltage and second voltage applied to the piezoelectric element while repeatedly measuring current flowing through the piezoelectric element; and deducing the resonance frequencies from the determined frequency characteristics.

5. The liquid ejection head inspection method of claim 4, wherein the frequency of at least one of the first voltage and the second voltage is varied in a range from 1 kHz to 1 MHz.

6. The liquid ejection head inspection method of claim 4, wherein at least the step of applying the second voltage for measuring the resonance frequency comprises applying a voltage to which a bias voltage is applied to the individual piezoelectric element, such that a polarity of the voltage that is applied to the piezoelectric element is constant through a period of measurement.

7. The liquid ejection head inspection method of claim 4, wherein the steps of applying the first and second voltages for measuring the resonance frequencies each comprise applying a voltage to which a bias voltage is applied to the individual piezoelectric element, such that a polarity of the voltage that is applied to the piezoelectric element is constant through a period of measurement.

8. The liquid ejection head inspection method of claim 1, further comprising the steps of:

for each individual piezoelectric element, calculating a reduction ratio of the resonance frequency at the time of application of the second voltage relative to the resonance frequency at the time of application of the first voltage; and if the reduction ratio is greater than or equal to a threshold value, judging that the piezoelectric element is a piezoelectric element that is likely to be susceptible to failure over time.

9. The liquid ejection head inspection method of claim 8, wherein the reduction ratio is calculated according to:

$$Ra=(f_L-f_H)\div f_L\times 100$$

in which $f_L$ is the resonance frequency at the time of application of the first voltage, $f_H$ is the resonance frequency at the time of application of the second voltage, and Ra is the reduction ratio of the resonance frequencies.

10. The liquid ejection head inspection method of claim 9, wherein the threshold value comprises a first threshold value $Ra_0$ and a second threshold value $Ra_1$, in which $Ra_0<Ra_1$, and the step of judging comprises:

(a) if Ra is larger than $Ra_1$, judging that the piezoelectric element has failed; and (b) if Ra is larger than $Ra_0$ but less than or equal to $Ra_1$, judging that the piezoelectric element is likely to be susceptible to failure over time.

11. The liquid ejection head inspection method of claim 1, further comprising:

writing results of detection of piezoelectric elements that are likely to be susceptible to failure over time to a recording device which enables reading and writing of information added to the liquid ejection head.

12. A printer device provided with a liquid ejection head which is equipped with a plurality of nozzles at which piezoelectric elements are provided and which ejects recording liquid droplets from the individual nozzles in accordance with application of a driving signal voltage to the individual piezoelectric elements, the printer device comprising:

a storage section that stores information representing piezoelectric elements that are likely to be susceptible to failure over time, which have been detected by a predetermined means for inspecting the liquid ejection head; and a driving control section that controls driving of the liquid ejection head so as to reduce frequencies of occurrence of driving of the piezoelectric elements that are likely to be susceptible to failure over time, on the basis of the information stored at the storage section, wherein the means for inspecting the liquid ejection head comprises:

means for applying a first voltage to each individual piezoelectric element for measuring a resonance frequency of the individual piezoelectric element;

means for applying a second voltage, which is higher than the first voltage, to each individual piezoelectric element for measuring a resonance frequency of the individual piezoelectric element; and means for, on the basis of the resonance frequencies at the times of application of the first voltage and the resonance frequencies at the times of application of the second voltage, detecting the piezoelectric elements that are likely to be susceptible to failure over time.

13. A printer device provided with a liquid ejection head which is equipped with a plurality of nozzles at which piezoelectric elements are provided and which ejects recording liquid droplets from the individual nozzles in accordance with application of a driving signal voltage to the individual piezoelectric elements, the printer device comprising:

a measurement section that applies a first voltage to each individual piezoelectric element for measuring a resonance frequency of the individual piezoelectric element and applies a second voltage, which is higher than the first voltage, to the individual piezoelectric element for measuring a resonance frequency of the individual piezoelectric element;

a detection section that detects piezoelectric elements that are likely to be susceptible to failure over time, on the basis of the resonance frequencies at the times of application of the first voltage and the resonance frequencies at the times of application of the second voltage, which have been measured by the measurement section;

a storage section that stores information representing the piezoelectric elements that are likely to be susceptible to failure over time, which have been detected by the detection section; and a driving control section that controls driving of the liquid ejection head so as to reduce frequencies of occurrence of driving of the piezoelectric elements that are likely to be susceptible to failure over time, on the basis of the information stored at the storage section.

14. The printer device of claim 13, wherein the measurement by the measurement section, of the resonance frequencies at the times of application of the first voltage and the resonance frequencies at the times of application of the second voltage, and the detection by the detection section of the piezoelectric elements that are likely to be susceptible to failure over time, are performed periodically.

15. The printer device of claim 13, wherein the second voltage comprises a magnitude substantially the same as a magnitude of the driving signal voltage.

16. The printer device of claim 13, wherein the first voltage and second voltage that are applied to the individual piezoelectric elements at times of measurement of the resonance frequencies comprise voltages whose magnitudes vary cyclically with certain amplitudes, and the measurement section:

determines frequency characteristics of impedance of each piezoelectric element, by varying frequencies of the first voltage and second voltage applied to the piezoelectric element while repeatedly measuring current flowing through the piezoelectric element; and deduces the resonance frequencies from the determined frequency characteristics that have been found.

17. The printer device of claim 16, wherein, at least when the measurement section applies the second voltage for measuring the resonance frequency, a bias voltage is added to the voltage that is applied to the individual piezoelectric element, such that a polarity of the voltage that is applied to the piezoelectric element is constant through a period of measurement.

18. The printer device of claim 13, wherein the detection section calculates, for each individual piezoelectric element, a reduction ratio of the resonance frequency at the time of application of the second voltage relative to the resonance frequency at the time of application of the first voltage and, if the reduction ratio is greater than or equal to a threshold value, judges that the piezoelectric element is a piezoelectric element that is likely to be susceptible to failure over time.

19. The printer device of claim 18, wherein the detection section calculates the reduction ratio of the resonance frequencies by:

$$Ra=(f_L-f_H)\div f_L\times 100$$

in which $f_L$ is the resonance frequency at the time of application of the first voltage, $f_H$ is the resonance frequency at the time of application of the second voltage, and Ra is the reduction ratio of the resonance frequencies.

20. The printer device of claim 19, wherein the threshold value comprises a first threshold value $Ra_0$ and a second threshold value $Ra_1$, in which $Ra_0<Ra_1$, and the detection section:

(a) judges that the piezoelectric element has failed if Ra is larger than $Ra_1$; and (b) judges that the piezoelectric element is likely to be susceptible to failure over time if Ra is larger than $Ra_0$ but less than or equal to $Ra_1$.

* * * * *